US006167911B1

(12) United States Patent
Diamond

(10) Patent No.: US 6,167,911 B1
(45) Date of Patent: Jan. 2, 2001

(54) AUTOMATIC VENT DEVICE THAT PREVENTS FUEL SPILLAGE FOR MARINE VESSELS

(76) Inventor: Burt Diamond, 13 Silver Brook Dr. P.O. Box 1182, Bridgeton, NJ (US) 08302

( * ) Notice: Under 35 U.S.C. 154(b), the term of this patent shall be extended for 0 days.

(21) Appl. No.: 09/203,226

(22) Filed: Nov. 30, 1998

(51) Int. Cl.[7] ..... B65B 31/00

(52) U.S. Cl. ..... 137/899.2; 137/587; 137/589; 440/89

(58) Field of Search ..... 137/587, 588, 137/899.2; 440/88, 89

(56) References Cited

U.S. PATENT DOCUMENTS

| | | | | |
|---|---|---|---|---|
| 291,084 | * | 1/1884 | Reinecke | 137/587 |
| 3,800,978 | * | 4/1974 | Sigwald | 137/587 |
| 4,082,125 | | 4/1978 | Wilson | 312/229 |
| 4,802,514 | | 2/1989 | Morse | 137/312 |
| 4,825,905 | | 5/1989 | Whitley, II | 137/587 |
| 4,974,645 | * | 12/1990 | Johnson | 137/587 |
| 5,070,806 | | 12/1991 | Coster | 220/86.2 |
| 5,088,947 | | 2/1992 | Whitley, II | 137/588 |
| 5,273,466 | | 12/1993 | Thompson | 137/587 |
| 5,322,099 | * | 6/1994 | Langlois | 137/587 |

FOREIGN PATENT DOCUMENTS

| | | | | |
|---|---|---|---|---|
| 1175097 | * | 7/1964 | (DE) | 137/587 |

* cited by examiner

*Primary Examiner*—A. Michael Chambers

(57) ABSTRACT

A vent device for marine vessels with internal fuel tanks, comprising an upper embodiment that is attached through a vessels hull and a lower embodiment that is attached to the fuel tank. Together they permit fumes to vent into the atmosphere while containing the fuel that usually expels during fueling. This fuel is automatically directed to return back into the fuel tank. This venting device while allowing air to enter, protects against rain, splash, spray and insects from entering the fuel system.

5 Claims, 3 Drawing Sheets

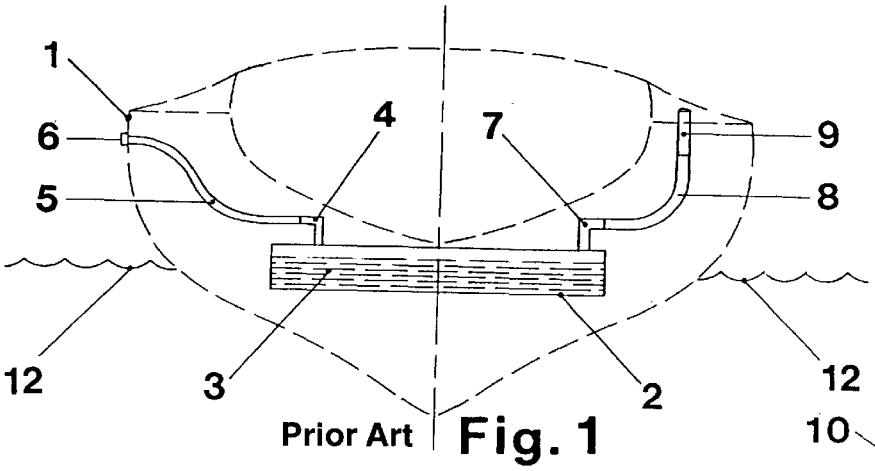
Prior Art Fig. 1
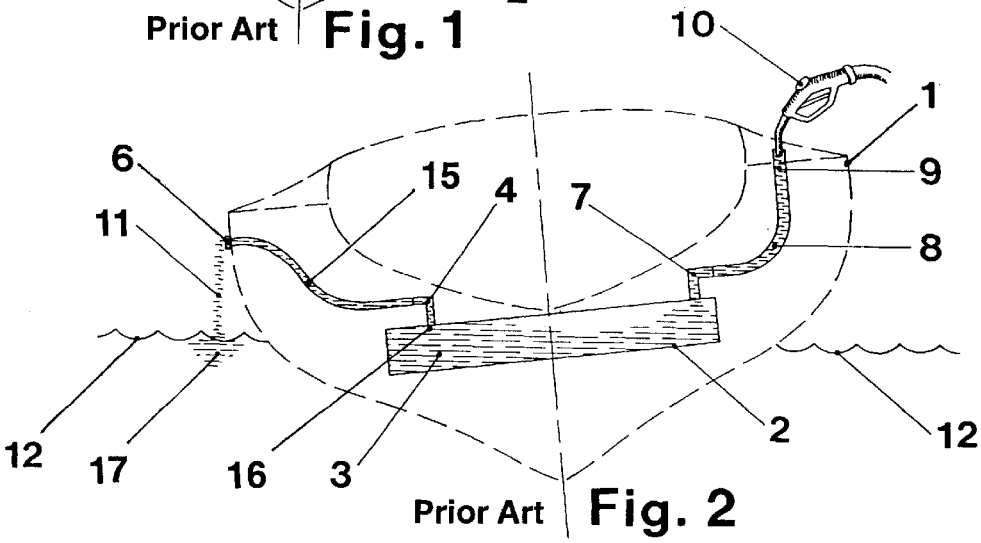
Prior Art Fig. 2
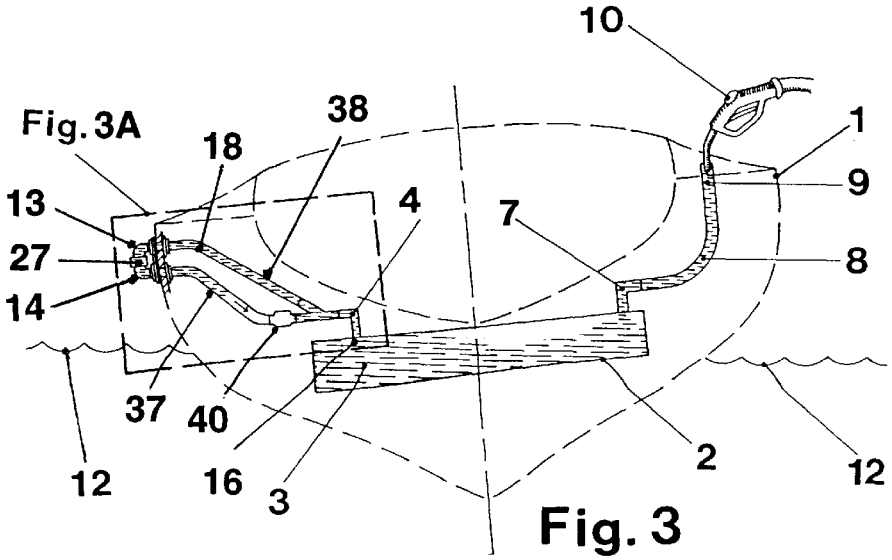
Fig. 3

AUTOMATIC VENT DEVICE THAT PREVENTS FUEL SPILLAGE FOR MARINE VESSELS

BACKGROUND FIELD OF INVENTION

This invention relates to a vent device used on internal fuel tanks installed on pleasure boats and other marine vessels. This device is designed with a self contained automatic means for containing and recycling the expelled fuel that is usually forced out of the air vent with the fumes. This occurs during fueling and other times when pressurized fuel enters the air vent. While preventing spills and pollution this invention also prevents rain water, splash water, most insects and other contaminants from entering the fuel system via the air vent.

BACKGROUND DESCRIPTION OF PRIOR ART

An internal fuel tank on a pleasure boat or other marine vessel must have an air vent to enable air and fumes under pressure, to escape, while fuel is being pumped into the fuel tank, via the fuel fill port. Conversely, as fuel is consumed by the engine, air must be able to move into the tank via the air vent to replace the vacuum created by the consumed fuel.

Prior art allows fumes and air to expel out through the air vent as well as fuel which spills into the waterway and acts as a visual signal for the boat owner or fuel dock attendant to determine when the tank is full. Prior art is only concerned with prevention of rain water, spray water and insects from entering through the air vent and into the fuel system. Prior art does not address the fact that fuel is expelled out onto the waterway through the vent causing environmental pollution.

The air vent is approximately 0.5" diameter while the fill port is approximately 1.5" diameter. As the fuel tank is being filled the boat or vessel tends to rock and list causing the liquid fuel to slosh back and forth within the fuel tank in accordance with the elements, such as; wind, tidal currents, wakes from other vessels and the movement from those on board. As the boat lists to the side where the air vent is situated, the liquid fuel rises on that side of the tank, this causes a false fill and causes fuel to expel out of the air vent, this spilling continues periodically during fueling, depending on the frequency and degree of the above mentioned marine elements. Finally, as the fuel tank actually becomes full, one final spill occurs, which combined with the prior spillage, causes pollution of the surrounding waterway.

External spillage collection devices of varying configurations have been designed in prior art, they are not compatible with all boat designs or vent positions, they are cumbersome as they are temporarily mounted to the exterior hull of the boat during fueling and are removed after fueling. The removal is awkward and liable to spill during removal, this prior art device can also spill when manually pouring back the fuel into the fill port.

Studies investigating spillage, as well as observations of the fueling procedure at various busy fuel docks, yielded the following results: the fuel dock attendants report that 80 of 100 boats during fueling will have spills of several ounces expelling out of the vent and into the waterway. For this reason most fuel docks keep cases of a soap product called "Liquid Dawn" available, which when applied on to a waterway affected by fuel spillage helps to camouflage the pollution by dispersing the sheen caused by the fuel spill. The boat owners that were interviewed reported that they spill fuel during fueling, most of the time.

The U.S. Department of Environmental Protection estimates there are approximately 12 million marine engines in our nations waterways. If only 75% are pleasure boats with internal fuel tanks, and we take an average of one fueling per week during a six month boating season and 75% of each fueling spills on average two ounces of either gasoline or diesel fuel, this causes a tremendous pollution problem. The above figures are conservative, the calculations are as follows: 105,468 gallons of gasoline and/or diesel fuel spill per fueling or per week and 2,531,250 gallons spill per six month boating season. This problem grows with every new boat purchased. While there are laws in place to prevent this pollution, they are not being enforced due to the enormity of the problem and a lack of manpower.

My invention corrects this problem by preventing this particular overflow vent spill pollution from taking place, either during fueling or at other times when fuel expansion takes place.

The present method of fueling an internal fuel tank on a pleasure boat or other marine vessel is as follows:

a) Unscrew the port fill cap which exposes the port fill opening that allows fuel to flow through to fill the fuel tank. Insert the fill nozzle that is attached to the fuel fill hose that leads from the main pump at the fuel dock into the fuel fill port opening, squeeze the trigger on the nozzle and fuel begins to flow through the fill port inlet, down the hose into the vessels internal fuel tank.

b) As the fuel enters the fuel tank the air within the fuel tank gets displaced by the incoming fuel, forcing the air to find a way out of least resistance, this being the through hull air vent.

c) A vessel floating on water lists and rocks in all directions in accordance with the elements, such as; wind, wake from other vessels, tidal currents and movement from those on board. This rocking motion causes the fuel to slosh back and forth and side to side within the fuel tank, when the motion causes the boat to tip in a direction allowing the fuel to rise up in the interior side of the tank where the venting is taking place, it causes a false momentary fill and will expel fuel out through the vent due to the rise of the incoming fuel, causing a fuel spill even before the tank is full. This condition can take place several times during fueling, depending on the frequency of motion caused by the elements, and the fuel tank capacity.

d) Rising temperature causes fuel to expand within internal fuel tanks, a spill occurs from fuel expansion caused by rising temperature when the tank is filled to maximum, known as topping off the tank, which is a common practise that minimizes the amount of moisture able to develop within the tank, it both preserves the tank and helps keep the fuel fresh and where diesel fuel is used, it cuts down on bacteria and algae growth. During the summer heat the fuel within the topped off fuel tank will expand expelling fuel out through the vent onto the waterway. Additionally, after boating season during land lay-up of the vessel, as the warm weather approaches and the fuel temperature rises the fuel expands and will expel out of the vent onto the ground, in both instances environmental pollution occurs.

Prior art external spillage collection devices are mounted only during fueling and are not used to catch spills caused by heat expansion of the fuel when the vessel is either water docked or dry docked.

SUMMARY OF THE INVENTION

A primary object of this invention is to prevent fuel spills and resulting pollution caused by pleasure boats and other marine vessels with internal fuel tanks. Fuel spills occur during fueling and at other times when tanks are substantially full and atmospheric temperatures rise causing the fuel to expand and expel out through the air vent. My invention prevents spilling from the air vent by having a permanent receptacle attached under and around the air vent that captures the expelled fuel and returns the fuel through a separate conduit of tubes and through a check valve back into the fuel tank. At no time is the expelled fuel vulnerable to spillage. As pressure causes the air, fumes and fuel from within the fuel tank to expel out toward the air vent, said air, fumes and fuel are directed through an upper vent tube toward the vent as they are unable to pass through the check valve of the lower return tube. As the fuel is forced through the vent tube toward the vent, the fuel is captured by an oversized fuel receptacle tube that fits widely and high enough around the vent tube to prevent any fuel from spilling yet allowing the air and fumes to escape into the atmosphere. The fuel then flows down into the return tube and through the check valve back into the fuel tank.

At the point where the curved vent tube leads into the fuel receptacle tube, the vent has a hood attached over it that extends down far enough over the fuel receptacle tube to prevent rain and spray water from entering the fuel system. The hood bottom has a perimeter of minute holes which screen out insects from entering the fuel system, while allowing fumes to escape and air to enter.

Additional advantages of this invention are:

The prevention of pollution by capturing and recycling the fuel that expels through the vent.

Ease of installation and replacement of prior art air/fume vent.

To provide a venting device that will not be adversely affected by gasoline, diesel fuel and the marine environment.

To provide a vent device that will prevent rain, spray water and insects from entering the fuel system.

BRIEF DESCRIPTION OF DRAWINGS FIGS. 1–6

FIG. 1 a boat, level in the water showing a cross section view illustrating the fuel tank with the fuel fill port to the right and the prior art vent to the left.

FIG. 2 shows a boat listing, creating a false fill and spill with prior art style vent showing overflow spillage during fueling.

FIG. 3 shows the same boat listing, creating a false fill, with the embodiment of the new vent invention inset FIG. 3A, illustrating the fuel recycling configuration, that prevents spillage.

Figure 4:
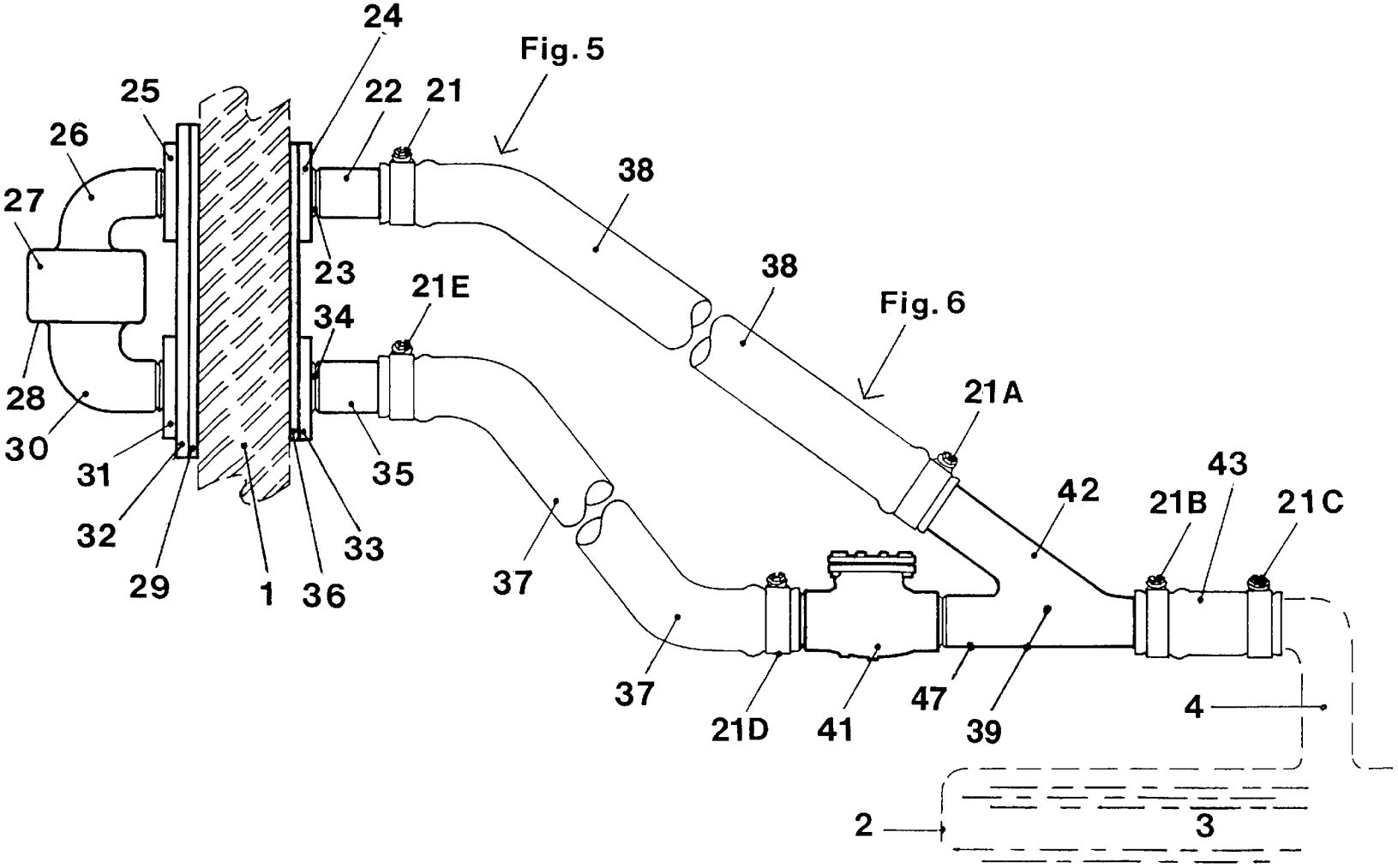
FIG. 4 is an enlarged view of inset 3A.

| Reference Numerals in Drawings | |
|---|---|
| 1 | Boat Hull |
| 2 | Fuel Tank |
| 3 | Fuel |
| 4 | Fuel Tank Vent Tube |
| 5 | Vent Hose Prior Art |
| 6 | Prior Art Vent |
| 7 | Tank Fill Fitting |

-continued

| Reference Numerals in Drawings | |
|---|---|
| 8 | Tank Fill Hose |
| 9 | Port Fill Fitting |
| 10 | Fill Nozzle |
| 11 | Backed Up Fuel Spilling |
| 12 | Water |
| 13 | New Vent Device Upper |
| 14 | New Vent Device Lower |
| 15 | Vent Hose Prior Art With Backed Up Fuel |
| 16 | False Fill |
| 17 | Expelling The Fuel |
| 18 | Backed Up Contained Fuel |
| 21 | Clamp |
| 21A | Clamp |
| 21B | Clamp |
| 21C | Clamp |
| 21D | Clamp |
| 21E | Clamp |
| 22 | Vent Tube |
| 23 | Threads on Vent Tube |
| 24 | Nut Interior |
| 25 | Nut Exterior |
| 26 | Curved Upper Vent Tube |
| 27 | Protective Hood |
| 28 | Lower Lip Vertical Holes |
| 29 | Rubber Gasket Exterior |
| 30 | Curved Receptacle Tube |
| 31 | Nut Exterior |
| 32 | Support Plate |
| 33 | Nut Interior |
| 34 | Threads on Receptacle Tube |
| 35 | Receptacle Tube |
| 36 | Rubber Gasket Interior |
| 37 | Hose Return to Fuel Tank |
| 38 | Vent Hose From Fuel Tank |
| 39 | Y-Connector |
| 40 | Check Valve |
| 41 | Check Valve Housing |
| 42 | Vent Upper/Y-Connector |
| 43 | Hose/Vent Coupling |
| 44 | Hose/Valve Coupling |
| 47 | Fuel Return Tube/Y-Connector |

DETAILED DESCRIPTION OF THE INVENTION

FIG. 1 Describes a boat equipped with prior art vent 6, floating level in the water 12, showing a cross section of an internal fuel tank 2, fuel 3, fuel tank fill fitting 7, hose 8 and fill port 9, being filled by nozzle 10. The fuel tank vent tube 4, attached to hose 5, which is also attached to prior art through hull vent 6, which vents to outside of boat hull 1.

FIG. 2 Describes the same boat equipped with prior art vent 6, listing to the left, no longer floating level in water 12, during fueling, with nozzle 10, delivering fuel 3, through port fill fitting 9, hose 8 and tank fill fitting 7, into fuel tank 2, causing fuel 3, to effect a false fill 16, to the left side of fuel tank 2, causing fuel tank vent tube 4, hose 5 and prior art through hull vent 6, to fill with backed up fuel spilling 11, shown expelling the fuel 17, into the water 12.

FIG. 3 Describes the same boat, equipped with the embodiment of the invention, the new vent device upper 13 and lower 14, as shown in inset 3A, listing to the left, no longer floating level in the water 12, during fueling, with nozzle 10, delivering fuel 3, through port fill fitting 9, hose 8 and tank fill fitting 7, into fuel tank 2, causing the fuel 3, to effect a false fill 16, to the left side of the fuel tank 2, causing the fuel tank vent tube 4, vent hose from fuel tank 38 and new vent device upper 13, to fill with backed up contained fuel 18, which flows through to new vent device lower 14, through hose return to fuel tank 37, through check valve 40 and on through fuel tank vent tube 4 and back into fuel tank 2. One must be aware that the listing or rocking motion of a boat causes a constant and immediate sloshing back and forth seesaw movement of the fuel 3, within the fuel tank 2, causes false fills 16, to occur sporadically and space becoming available sporadically, within the fuel tank 2, to accept the fuel 3, as it is returned to the fuel tank 2, via hose return to fuel tank 37.

FIG. 4 Is an enlarged view of the entire embodiment of the invention, as shown in inset FIG. 3A.

Figure 5:
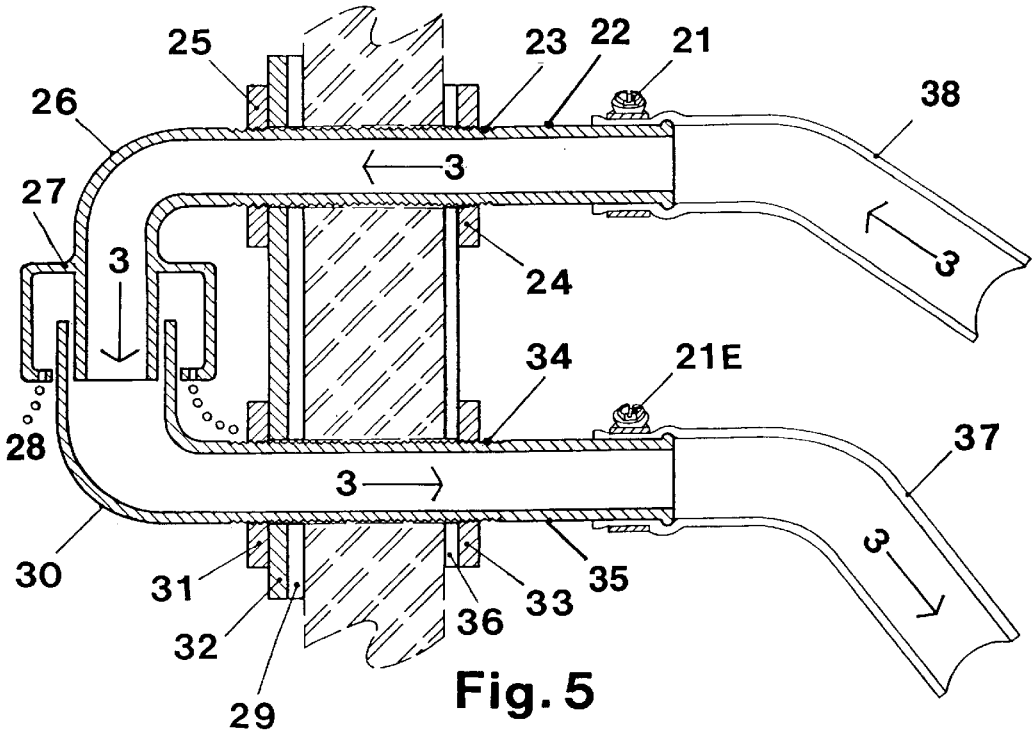
FIG. 5 is a perspective view of the new vent device upper, through hull portion of the embodiment of the invention.

FIG. 5 Is a perspective view of the through hull portion of the embodiment of the invention showing the fuel 3, flow direction depicted by arrows, the vent hose from fuel tank 38, being attached by clamp 21, to curved upper vent tube 26, having threads on vent tube 23, which accepts nut interior 24, which together with nut exterior 25, support plate 32, rubber gasket interior 36, and rubber gasket exterior 29, enable an adjustable secure affixing of the curved upper vent tube 26, to the boat hull 1. Protective hood 27, being a part of curved upper vent tube 26, and having lower lip vertical holes 28, at its underside, enabling fumes to be expelled and air to enter, while preventing water, insects and other undesireable matter from entering the fuel 3 system also prevents fuel 3, from spilling as the curved upper vent tube 26, is recessed inside the curved receptacle tube 30. While the protective hood 27, envelopes the upper opening of the curved receptacle tube 30. Curved receptacle tube 30, is positioned to fit accordingly inside the protective hood 27 and outside the curved upper vent tube 26, by means of the threads on receptacle tube 34, being able to be adjusted in accordance with the dimensional thickness of the boat hull 1, by either tightening or loosening nut exterior 25 and 31, in conjunction with nut interior 24 and 33 and made secure by tightening against support plate 32 and rubber gasket exterior 29 and rubber gasket interior 36. Curved receptacle tube 30, is attached via clamp 21E, to hose return to fuel tank 37.

Figure 6:
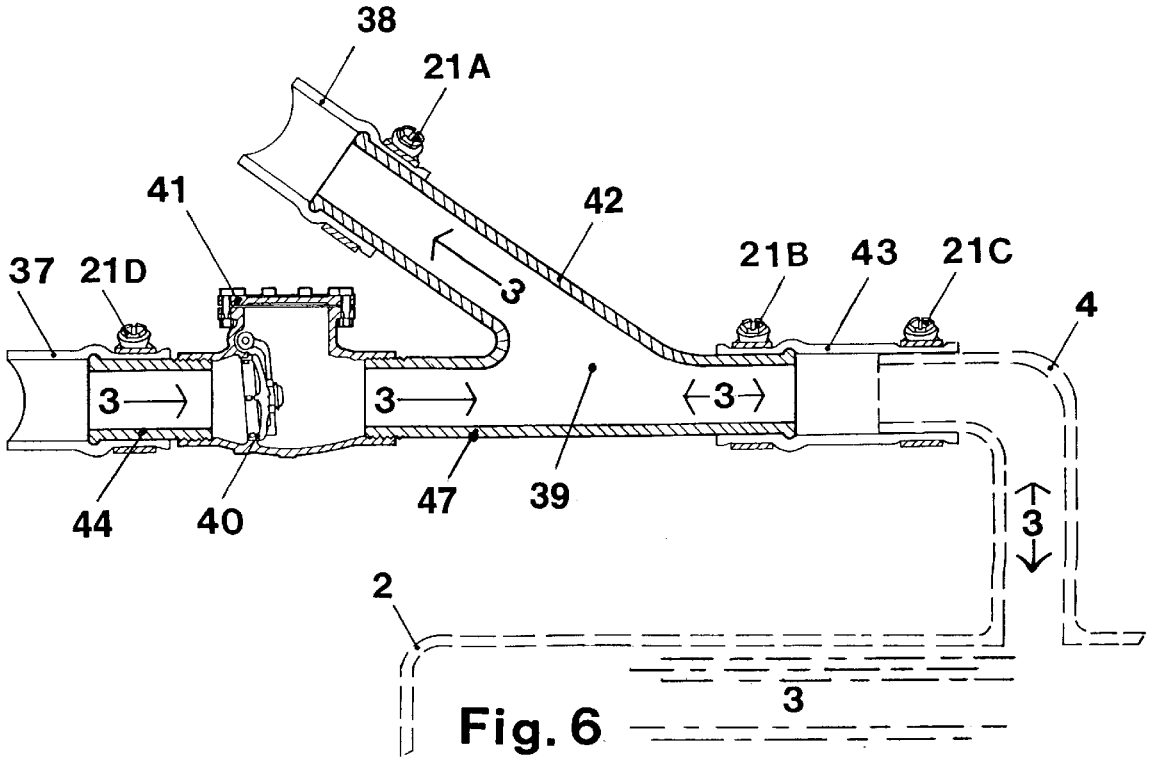
FIG. 6 is a perspective view of the new vent device lower, fuel tank fitting and check valve showing fuel flow directions within the embodiment of the invention.

FIG. 6 Is a perspective view of the fuel tank vent fitting portion of the embodiment of the invention showing the hose/vent coupling 43, being attached to the fuel tank vent tube 4 and to the Y-connector 39, by clamps 21C and 21B. The vent tube upper/Y-connector 42 and the fuel return tube/Y-connector 47, together comprise Y-connector 39. The vent tube upper/Y-connector 42, is connected to vent hose from fuel tank 38, by clamp 21A. The hose return to fuel tank 37, is connected via clamp 21D, to hose/valve coupling 44, which is attached by means of threads to check valve housing 41, which contains check valve 40, which allows a one directional flow of fuel 3, through fuel return tube/Y-connector 47, into the fuel tank 2.

I claim:

1. A fuel tank vent comprising:

a) an upper embodiment with a plurality of upper through hull tubes and a plurality of flexible hoses attached to the open end of said through hull tubes as they protrude through into the interior of a marine vessel's hull;

b) said plurality of upper through hull tubes further including an upper tube and a lower tube passing through said hull parallel to each other and the water line, located substantially above said water line of said vessel's hull and substantially above the top of said vessel's fuel tank;

c) said upper and lower tubes of said upper embodiment communicate with each other at the exterior of said hull by means of said upper tube curving down vertically and said lower tube curving up vertically and receiving within each others several orifices which overlap and fit spaciously within each others open orifice tubes, thereby preventing spillage by directing and controlling the flow and recycling said fuel back into said fuel tank.

2. Said flexible hoses of said upper embodiment of claim 1 having an upper flexible hose attached to said upper through hull's tube's upper tube communicates and is attached to said lower embodiment's said upper tube branch, having no restrictions.

3. Said flexible hoses of said upper embodiment of claim 1 having a lower flexible hose attached to said upper through hull's tube's lower tube communicates and is attached to said lower embodiment's said lower tube branch, having no restrictions in the flow direction toward said fuel tank.

4. The upper embodiment of claim 1 having vertically aligned said upper and lower exterior curved tubes which overlap and fit spaciously within each other's said orifice tubes, said openings being directed vertically downward thereby spaciously fitting simultaneously into and around said lower curved receiving tube, said upper orifice outer tube substantially covers said lower exterior upward curved tube thereby preventing certain outer negative elements from entering said fuel tank, said upper orifice outer tube further includes a plurality of small vertical openings, which combined with said spacious fitting within each other's orifice, allows access in or out for both air and fumes between the atmosphere and said internal fuel tank.

5. A fuel tank vent comprising:

a lower embodiment with a plurality of tubes attached to said plurality of hoses which communicate with said upper embodiment's tubes, said lower embodiment having one tube communicating with a vent tube from said fuel tank, said members opposite end branching into a Y configuration having two separate tubes, the lower said tube branch attached to a check valve, said check valve allowing said fuel to only flow in a direction toward said fuel tank, further including the upper tube branch directing said fuel and said fumes toward said upper vent tube of said upper embodiment causing said fuel to travel in one direction assuring recycling back into said fuel tank, accordingly said fumes travel in one direction and exit the system through said spacious fitting orifices at said hull exterior via said upper embodiment.

* * * * *